United States Patent [19]

Kaspar et al.

[11] Patent Number: 4,728,538

[45] Date of Patent: Mar. 1, 1988

[54] METHOD AND APPARATUS FOR IMPRINTING NON-SLIP COMPOSITION ON A GARMENT

[75] Inventors: Peter D. Kaspar; Wilbert Melvin, Jr., both of Dover, Del.

[73] Assignee: Danpen, Inc., New York, N.Y.

[21] Appl. No.: 879,547

[22] Filed: Jun. 24, 1986

Related U.S. Application Data

[63] Continuation of Ser. No. 659,042, Oct. 9, 1984, abandoned.

[51] Int. Cl.[4] ..... B05D 5/02; B05D 1/28; B05C 1/02

[52] U.S. Cl. ..... 427/288; 118/202; 118/211; 118/257

[58] Field of Search ..... 427/282, 288; 118/257, 118/202, 211; 101/120, 126, DIG. 7, DIG. 27

[56] References Cited

U.S. PATENT DOCUMENTS

| | | | |
|---|---|---|---|
| 266,614 | 10/1882 | Douglass | 2/241 |
| 2,725,567 | 12/1955 | Bevier | 2/83 |
| 2,962,384 | 11/1960 | Ljungbo | 428/197 |
| 3,212,103 | 10/1965 | Goodman | 2/409 |
| 3,370,363 | 2/1968 | Kaplan | 36/9 R |
| 3,383,782 | 5/1968 | McGinnity | 36/3 A |
| 3,915,087 | 10/1975 | Tiemann | 101/177 X |
| 4,021,860 | 5/1977 | Swallow et al. | 2/239 |
| 4,069,515 | 1/1978 | Swallow et al. | 2/239 |
| 4,206,514 | 6/1980 | Yamauchi | 2/239 |
| 4,206,515 | 6/1980 | Robinson | 2/241 |
| 4,276,671 | 7/1981 | Melton | 12/142 T |

*Primary Examiner*—Evan K. Lawrence

*Attorney, Agent, or Firm*—Grimes & Battersby

[57] ABSTRACT

An apparatus and method for using the apparatus are provided for continuously applying a dot pattern of a non-slip composition to a plurality of garments. The apparatus includes a delivery unit for delivering the plurality of garments and a transfer unit for imprinting continuously the dot pattern in the plurality of garments. The transfer unit includes a transfer roller which basically is a screen in the form of a cylinder having a plurality of holes provided therein arranged in the dot pattern to be imprinted in the garments. A unit is provided for introducing the composition into the transfer roller. A further unit is provided for forcing the composition through the plurality of holes. A transfer belt is provided and is positioned adjacent the transfer roller and is adapted to continuously receive the dot patterns of the composition from the transfer roller and transfer them onto the garments delivered by the delivery unit. The dot patterns are dried while the garments are in contact with the transfer belt.

21 Claims, 7 Drawing Figures

METHOD AND APPARATUS FOR IMPRINTING NON-SLIP COMPOSITION ON A GARMENT

This application is a continuation of application Ser. No. 659,042, filed Oct. 9, 1984, now abandoned.

BACKGROUND OF THE INVENTION

1. Field of the Invention

The present invention relates generally to a method and apparatus for imprinting a non-slip composition in at least one surface of a garment such as, for example a hosiery product such as tights or pantyhose. In accordance with the method and apparatus, a plurality of dots of the non-slip composition are imprinted on the surface of the garment during the finishing operation.

Garments of the type contemplated include hosiery products which have non-slip portions on the soles thereof to increase the gripping surface of the garment on smooth floors or gym mats. The non-slip portions may be included on the soles of virtually any hosiery product including, for example, tights, pantyhose, stockings, socks, or the like.

The non-slip composition which is applied using the method and apparatus of the present invention includes a frictional component such as, for example, a latex rubber or silicone rubber composition.

2. Description of the Related Art

Garments such as slippers and shoes with non-slip soles have been known for many years. For example, U.S. Pat. No. 2,725,567, which issued to L. H. Bevier on Dec. 6, 1955, is directed to a Child's Sleeping Garment which includes a sole piece formed of unnapped fabric impregnated with a synthetic resin material to form a soil resistant, tough outer layer. See also, U.S. Pat. No. 3,383,782 which issued to J. R. McGinnity on May 21, 1968 for Articles of Footwear in which wear resistant ventilated outersoles are provided for articles of footwear such as bottoms of slippers, bootees, sock feet and the like; and U.S. Pat. No. 4,276,671 which issued to F. Melton on July 7, 1981 for a Method of Making a Slipper Sock wherein a slipper sock is provided which includes a thin and flexible bottom piece affixed to the sole thereof.

Hosiery products having non-slip sole portions are also well known. For example, U.S. Pat. No. 266,614, which issued to E. N. Douglass on Oct. 31, 1882 for a Bathing Stocking, contains india-rubber or other substantial and flexible water-proof material applied on the bottom of the foot portion thereof. U.S. Pat. No. 3,212,103, which issued to N. H. Goodman on Oct. 19, 1965 for Elastic Mesh Ballet Tights, is directed to a pair of dancer's tights with a sole piece. U.S. Pat. No. 4,021,860, which issued to R. T. Swallow, et al. on May 10, 1977, is directed to a Non-Slip Therapeutic Stocking and Method and includes a therapeutic stocking having a lower non-slip region of the foot portion comprising sheet means of a thermoplastic material fused to the outside of a circumferentially prestretched area. See, also, U.S. Pat. No. 4,069,515 which issued to R. T. Swallow, et al. on Jan. 24, 1978 and which is a division of the Swallow, et al. '860 patent. In U.S. Pat. No. 4,206,514, which issued to A. Yamauchi on June 10, 1980, for Sanitary Footgear Articles, each article is provided in the form of a sock or stocking which includes a plurality of dots of a sanitary composition which directly contact the sole of the wearer. See also, U.S. Pat. No. 2,962,384 which issued to S. Ljungbo on Nov. 29, 1960 wherein a plurality of spots of adhesive material are provided on knitted stockings to prevent running of the stockings. U.S. Pat. No. 4,206,515, which issued on June 10, 1980 to J. Robinson, provides an athletic sock which contains a padded bottom, latex portion.

Still other hosiery products have been marketed which include elastomeric materials painted onto the soles of the foot portions or in which non-slip appliques are sewn onto the soles of such garments.

The means for applying such materials onto the surfaces of such garments vary widely. Since, however, most of the non-slip portions have solid portions, invariably such portions are applied by affixation or sewing rather than the relatively simple method and apparatus provided for herein wherein the dots are directly imprinted onto the surface of the garments.

Garments wherein an elastomeric material is painted onto the soles of the garment are generally commercially unacceptable due to the drastic change of hand in the area in which the polymer is applied. It has further been found that when the polymer is painted on, it does not wick into the body of the fabric but instead tends to remain predominantly on the surface of the fabric thereby reducing elasticity of that portion of the fabric. Such disadvantages deleteriously affect the durability and commercial marketability of the garment.

SUMMARY OF THE INVENTION

Against the foregoing background, it is a primary object of the present invention to provide a method and an apparatus for imprinting a non-slip composition in a portion of a garment.

It is another object of the present invention to provide such method and apparatus wherein dots of the non-slip composition are imprinted in the garment.

It is still another object of the present invention to provide such method and apparatus wherein the dots are imprinted in a plurality of garments during the garment finishing operation.

It is yet still another object of the present invention to provide such method and apparatus wherein the dots are indirectly printed in the garments using a heated transfer belt.

It is still yet another object of the present invention to provide such method and apparatus having delivery means for continuously delivering a plurality of garments to transfer means where the dots of non-slip composition are printed in the continuously delivered garments.

It is still yet another object of the present invention to provide such method and apparatus to apply accurately the amount of non-slip composition so that it penetrates into the substrate enough to provide a durable bond yet does not come through the substrate to the extent that it would be felt by the wearer, which accuracy of metering also assures maximum anti-slip properties per amount of latex used.

These and other objects of the present invention are attained by providing apparatus for continuously applying a dot pattern of a non-slip composition to a plurality of garments. The apparatus includes delivery means for delivering the garments and transfer means for continuously imprinting the dot pattern onto the delivered garments. The transfer means includes a transfer roller which basically is a screen in the form of a cylinder having a plurality of holes provided therein arranged in the dot pattern to be imprinted onto the surface of the garments. Means are further provided for introducing the composition into the transfer roller. Means are also provided for forcing the composition through the plurality of holes. Transfer is effected by use of a transfer belt which is positioned adjacent to the transfer roller and is adapted to receive the continuous dot patterns of the composition from the transfer roller and transfer them onto the garments delivered by the delivery means.

In accordance with the method of the present invention, a method is provided for continuously applying a dot pattern of a non-slip composition to a plurality of garments, said method comprising the steps of: delivering the plurality of garments by conveyor means to a transfer apparatus which applies the dot pattern; introducing the composition into a transfer roller provided in the transfer apparatus, the transfer roller having a screen with a plurality of holes provided therein arranged in the dot pattern to be transferred to the garments; forcing the composition through the holes onto a transfer belt positioned in contact with the transfer roller; transferring the dot patterns from the transfer belt to the garments; and removing the garments from the conveyor means.

Other objects, advantages and novel features of the present invention will become apparent from the detailed description of the invention when considered in conjunction with the accompanying drawings.

DETAILED DESCRIPTION OF THE PREFERRED EMBODIMENTS

Figure 1:
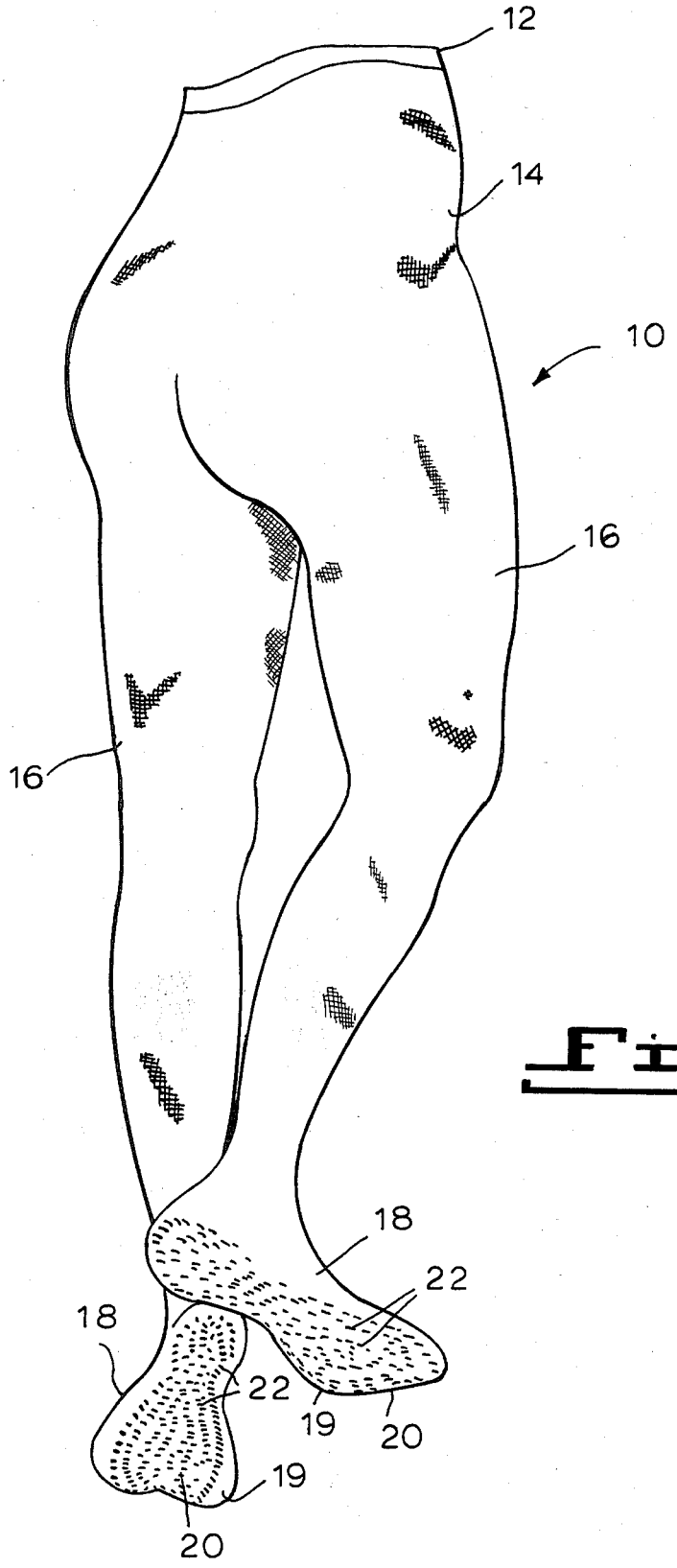
FIG. 1 is a front elevational view of a hosiery product having a non-slip sole on the foot portion thereof.

Referring now to FIG. 1, there is shown a hosiery product, in particular, a pair of tights, which is generally referred to by reference numeral 10. The pair of tights 10 illustrated in FIG. 1 is of a conventional, stretch design and, preferably, is of the type normally worn by people engaged in vigorous exercise or dance. The pair of tights 10, which is adapted to be worn without sneakers or other outer footwear, includes a waistband 12, which may be elastic, and also includes a trunk portion 14 and two leg portions 16, each of which terminate in a foot portion 18 having a sole 19 at the bottom thereof. Specific garments which may be manufactured using the subject method and apparatus are described, for example, in commonly assigned, companion patent application Ser. No. 658,980, filed on Oct. 9, 1984 and entitled "Garment Having Non-Slip Portion and Non-Slip Composition", now abandoned, the disclosure of which is hereby incorporated herein by reference.

Figure 3:
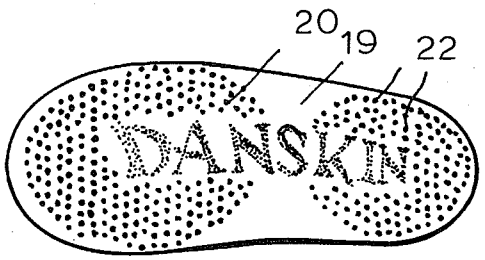
FIG. 3 is an alternative embodiment of the non-slip portion as applied to the sole of a hosiery product.
Figure 2:
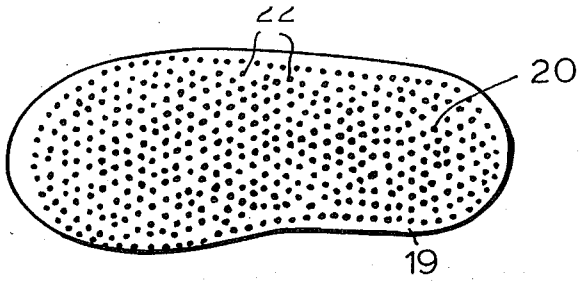
FIG. 2 is a bottom view of the sole of one foot portion of the hosiery product of FIG. 1.

As best illustrated in FIGS. 1–3, the soles 19 each include non-slip portions 20 which are adapted to provide a better grip on the floor for the wearer, especially during performances of the wearer on gymnasium or other hard, waxed floors. The non-slip portions 20 provided on the soles 19 of the foot portions 18 constitute a plurality of individual dots 22 of a non-slip composition, and can be in a regular or random pattern about the surface of the soles 19. It will be appreciated that the individual dots can be of a variety of shapes, for example, circles or dots, diamonds, squares, etc.

The non-slip composition applied to the soles 19 is an appropriate frictional material, preferably in latex form. Preferred frictional materials include silicone rubber such as General Electric RTV silicone rubber or hevea rubber, preferably in latex form. Other frictional materials which can be used include polyurethane and synthetic rubbers including polyisoprene. It has been found that while silicone rubber has good frictional properties, it is expensive and presents certain curing and handling problems. As a result, a pre-cured, unloaded latex form of natural hevea rubber is particularly preferred as the frictional material included in the composition. By using such a pre-cured latex composition, the garment need only be dried after application of the composition and does not have to be cured at an elevated temperature. Depending upon the speed and temperature at which the method and apparatus of the present invention operates, in certain instances it may be necessary to include a heat sensitizing agent to the composition such as, for example, ammonium nitrate.

The non-slip composition is, preferably, compounded by first introducing the frictional material, preferably the natural, pre-cured latex rubber into a mixing vessel. A particularly preferred natural latex is marketed by Walsh Chemical which includes accelerators and other additives. For example, zinc mercaptobenzothiazol and zinc dithiocarbamate may, if desired, be included in the natural latex in amounts up to about 3 parts per hundred parts of dry rubber if desired. Similarly, sulphur and ammonium hydroxide may be included in the latex in amounts up to about 1 part per hundred of dry rubber and, preferably, in amounts approximately 0.5 parts per hundred of dry rubber.

A stabilizer, such as potassium hydroxide, is added in an amount up to about 1 part per hundred parts of the dry rubber and, most preferably, in an amount up to about 0.5 parts per hundred parts of the dry rubber.

A thickening agent is then added to the composition in an amount sufficient to obtain a desired viscosity in the final composition. During processing, it is important that the composition be sufficiently viscous to permit it to be printed onto the garment and not so viscous as to prevent it from penetrating the substrate. While any conventional thickening agent such as, for example, clays, bentonites, acrylsols and the like can be employed, it has been found that a particularly preferred thickening agent is an alkali soluble carboxylated polymeric thickener such as the one marketed by Reichhold Chemicals under the trademark Tychem 68-710. The thickening agent should be added in any amount sufficient to obtain the desired viscosity in the end product. When the thickening agent is a carboxylated polymeric thickener such as Tychem, it can be added in an amount between about 0.10 and about 1 parts per hundred parts of dry rubber and, preferably, in an amount between about 0.25 and about 0.5 parts per hundred parts of dry rubber.

In certain instances it may be necessary to add a destabilizer or heat sensitizing agent to the latex rubber, particularly where the imprinting operation is not done at an elevated temperature. The heat sensitizing agent serves to destabilize the latex compound in the presence of heat to cause a gel to be formed quickly. A preferred heat sensitizing agent is ammonium nitrate and may be included in an amount between about 0.5 and about 3.0 parts per hundred parts of dry rubber. A preferred amount of the heat sensitizing agent is about 2.0 parts per hundred parts of dry rubber.

The above ingredients or components are added under constant agitation and at ambient temperature. The resultant composition is sufficiently viscous so that it cannot be poured but rather it must be extruded.

As shown in FIGS. 2 and 3, the dots 22 of the non-slip composition may be applied in a generally regular or random pattern about the sole 19 of the foot portion 18 of the garment. As illustrated in FIG. 2, the dot pattern 22 may be somewhat uniformly applied over the entire surface of the sole 19 of the foot portion 18 or, as illustrated in FIG. 3, it can be applied only over the toe and heel portions of the sole 19. If desired, as illustrated in FIG. 3, the dots 22 may be so patterned as to spell out a word, symbol, trademark or other advertising message.

The dots 22 of the non-slip composition should be flat, i.e., have a flat surface and be of a substantially uniform diameter, to enhance the amount of friction force to prevent sliding. The density of the dots, i.e., the number of dots per square inch on the fabric, are a function of a judicious tradeoff between the amount of gripping required and the effect that the presence of the dots have on the ability of the fabric to stretch.

The application of the non-slip composition in a "dot" pattern in the fabric of the garment serves to increase the frictional contact of that portion of the garment with objects which it may contact. For example, when the non-slip composition is applied to the soles 19 of a pair of tights, the tendency of the wearer to slip on a waxed or otherwise shiny floor is substantially reduced.

FIGS. 4–7 illustrate the manner in which the non-slip dots 22 may be directly applied to a plurality of garments in a production environment, in particular, to a plurality of pairs of tights, pantyhose or other hosiery products. It should be understood that the applying of the dots 22 of the non-slip composition to the garments in accordance with the present invention includes imprinting onto, on or in the fabric of the garment fabric, with the latter being the most preferable. As shown, in particular, in FIG. 4, the apparatus includes transfer apparatus 30 which includes a frame 32 which supports at its opposite ends a drive roller 40 and a transfer station 50. A continuous transfer belt 45, preferably a Teflon coated fiberglass belt, is provided between the drive roller 40 and the transfer station 50 and serves to transfer the non-slip composition in a predefined dot pattern onto the garment. The garments illustrated in FIGS. 4–7 are tights or pantyhose and the non-slip composition in a dot pattern 22 is directly applied to the soles 19 of the foot portions 18 thereof. It will, of course, be appreciated that the transfer apparatus 30 may be used to transfer the non-slip composition to a variety of different garments in a variety of different patterns depending upon the desired pattern and garment.

The transfer station 50 includes a guide roller 52, a transfer roller 54 and a delivery roller 56. As shown in greater detail in FIGS. 5 and 6, the transfer roller 54 may be basically a screen 58 in the form of a cylinder having a plurality of holes 59 arranged in continuous arrays of dot pattern 22 provided about the circumference of the formed screen cylinder. Alternatively, the transfer roller 54 may be a cylinder having a screen about its outer periphery, which screen has a plurality of holes arranged in continuous arrays of dot pattern provided about the circumference of the cylinder. The transfer roller 54 is adapted to transfer the non-slip composition in the dot pattern onto the conveyor belt 45 as shown in the FIGS. 4–7.

It is preferred that the thickness of the screen 58 be approximately 0.010" in thickness. It has been found that when the thickness of the screen 58 is greater than 0.012", the non-slip composition is delivered in such amounts that it will penetrate through the fabric of the garment. Similarly, it has been found that when this thickness of the screen 58 is less than 0.010", say for example 0.008", the non-slip composition is delivered in an amount insufficient to achieve a suitable bond with the fabric.

Contained within transfer roller 54 is a reciprocating rod 60 which is adapted to provide stability for the transfer roller 54 and a delivery tube 62 for delivering the non-slip composition to the interior of the transfer roller. Delivery tube 62 is supported in the interior of the transfer roller 54 by a brace 63 mounted on the reciprocating rod 60. Delivery tube 62 is adapted to deliver a continuous stream of the non-slip composition from a reservoir (not shown) of the composition to the lower portion of the transfer roller 54 where the non-slip composition is forced through the plurality of holes 59 by a doctor blade 64 and delivered onto the transfer belt 45. The transfer belt 45, with the dot pattern 22 transferred thereon, then travels about delivery roller 56 and contacts the soles 19 of the foot portions 18 of a pair of tights 10 to transfer the dot pattern onto the soles, which tights are each mounted on a mandrel 70 which travels in a conveyor arrangement 75 below the transfer belt 45.

Figure 7:
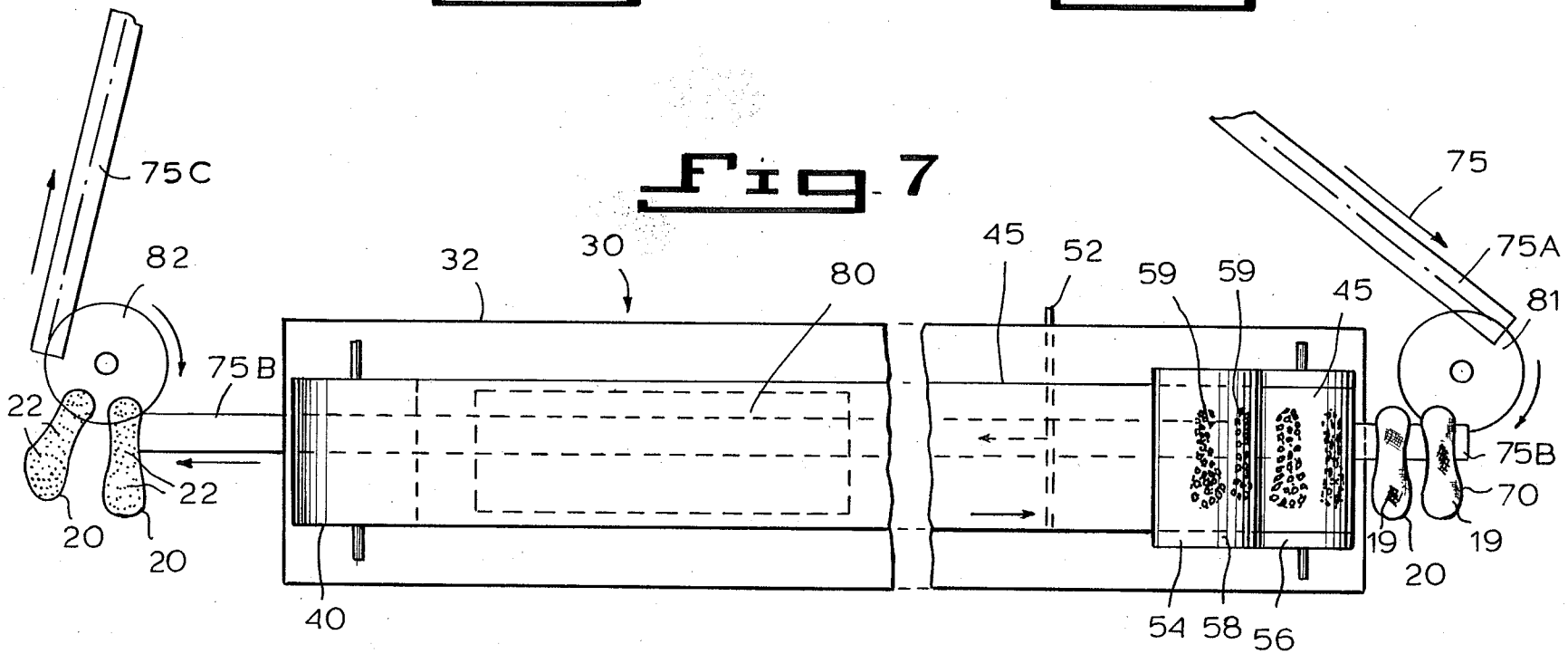
FIG. 7 is a top view of the apparatus of FIG. 4.
Figure 4:
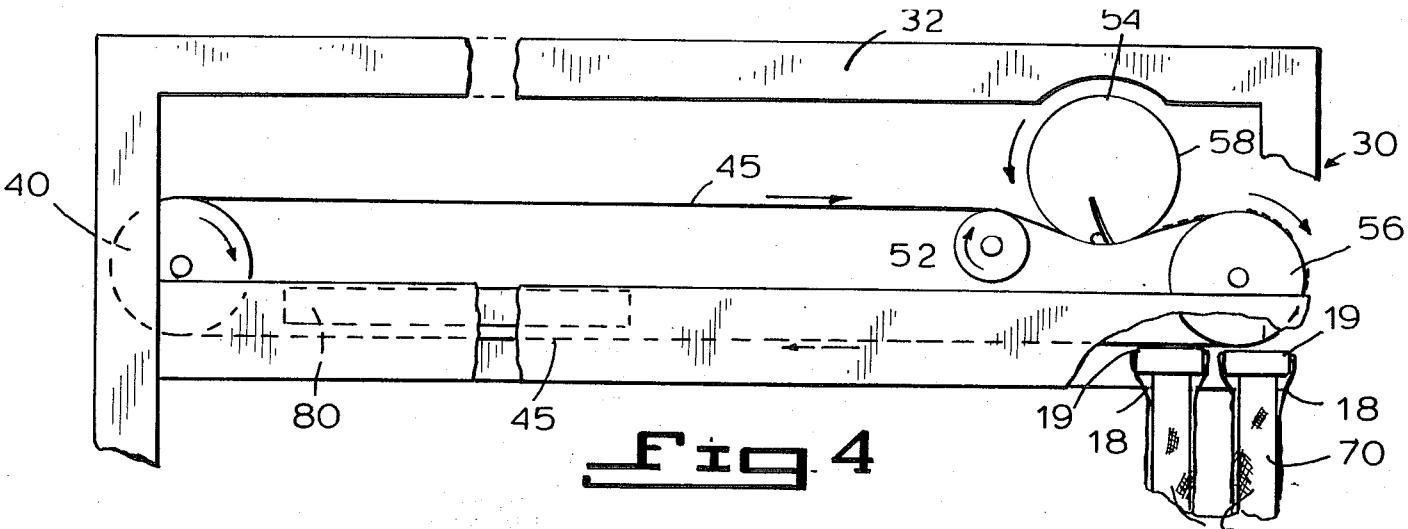
FIG. 4 is a side elevational view illustrating the apparatus of the present invention which is adapted to apply the non-slip portion to soles of hosiery products.
Figure 5:
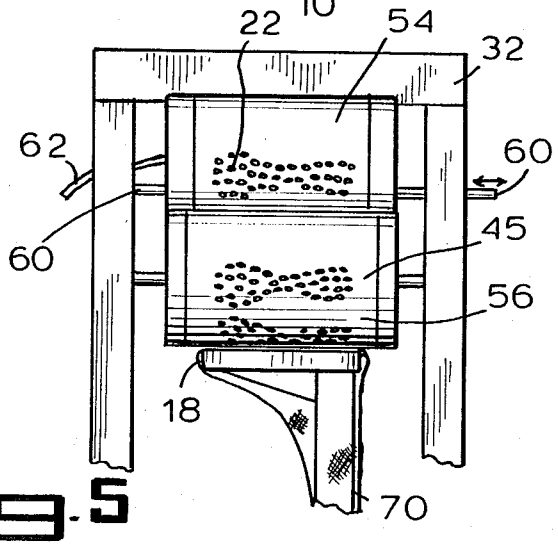
FIG. 5 is an end view illustrating the apparatus of FIG. 4.
Figure 6:
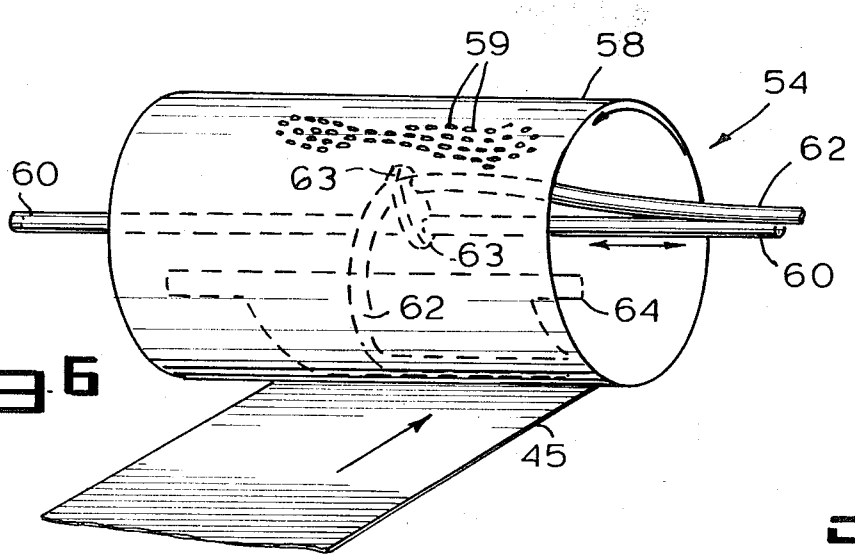
FIG. 6 is a perspective view of the transfer roller used in the apparatus of FIG. 4.

As shown in FIG. 7, a series of matched pairs of mandrels 70 travel along the conveyor arrangement 75 having three continuous legs 75A, 75B and 75C which are angularly positioned relative to each other so as to form a triangular arrangement. As the mandrels 70 travel through the first leg 75A, each pair of tights 10 is adapted to be sufficiently drawn over and down a matched pair of mandrels 70 so as to permit the sole 19 of the foot portion 18 of the tights 10 to stretch over the mandrel 70 in a sole-up position and remain in that position as the mandrels 70 travel along the first and second legs 75A and 75B, respectively. Further pairs of tights 10 are then continuously placed on the mandrels 70 as the conveyor arrangement 75 carries the "loaded" mandrels toward the second leg 75B which is positioned below the transfer apparatus.

The mandrels 70 with the tights 10 drawn thereon and with the soles 19 in a face-up position on the mandrels, then turn around a turning block 82 in the conveyor arrangement 75 and enter the second leg 75B which is parallel to and positioned below the frame 32 of the transfer apparatus 30. As the soles of the tights 10 begin to pass along the second leg 75B, they immediately pass below the delivery roller 56 which causes the conveyor belt 45 having the dot pattern 22 thereon to come into contact with the upward facing soles 19 of the tights 10. The pattern 22 is then imprinted or transferred onto the soles 19 of the tights 10. Actual transfer of the pattern from the conveyor belt 45 to the tights 10 is assisted by the pressure between the delivery roller 56 and the mandrel 70 which pressure is applied from the mandrels to cause the transfer belt 45 and the soles of the tights 10 on the mandrels to be forced together. Such pressure may be less than 1 psi and, preferably is about 0.5 psi.

Contact between the soles 19 of the tights 10 and the conveyor belt 45 continues along the length of the second leg 75B of the conveyor arrangement. The tights 10, still in contact with the conveyor belt 45, then pass through a heating zone 80 in which drying of the non-slip composition applied in a dot pattern to the soles 19 is accelerated. The heat in the heating zone 80 may include a heating plate and, in any event, may be applied in any conventional manner. The mandrels 70 containing the soles 19 of the tights 10 then travel beyond the heating zone 80 and the frame 32 of the conveyor transfer apparatus 30, around a second turning block 82 and then enter the third leg 75C of the conveyor arrangement 75 where the tights 10 are stripped off the mandrels 70 and transmitted to a subsequent station for subsequent processing, i.e., packaging, inspection or the like.

It will, of course, be appreciated that variations in the processing apparatus may be required to accommodate different types of garments and different patterns to be applied.

Having thus described the invention with particular reference to the preferred forms thereof, it will be appreciated that various changes and modifications may be made therein without departing from the spirit and scope of the invention as defined by the appended claims.

Wherefore, we claim:

1. Apparatus for continuously applying a dot pattern of a non-slip composition to a plurality of garments, said apparatus including delivery means for delivering said plurality of garments and transfer means for continuously imprinting said dot pattern onto said plurality of garments, said transfer means including a transfer roller comprising a screen with a plurality of holes provided therein arranged in the dot pattern which is to be imprinted onto said garments, means for introducing said composition into said transfer roller, means for forcing said composition through said plurality of holes, a rotating transfer belt positioned adjacent to said transfer roller and adapted to continuously receive said dot pattern of said composition from said transfer roller and transfer the dot pattern of said composition onto said garments delivered by said delivery means, and heating means adapted to heat said rotating transfer belt to accelerate the drying of the non-slip composition imprinted onto said garments while said garments are in contact with said belt.

2. The apparatus of claim 1, wherein said screen cylinder of said transfer roller includes a plurality of dot patterns about its circumference, each in said shape of said dot pattern to be transferred to said garments.

3. The apparatus of claim 1, wherein said means for introducing comprises a feed pipe adapted to convey said composition from a reservoir into the interior of said transfer roller.

4. The apparatus of claim 1, wherein said means for forcing comprises a doctor blade adapted to force said composition through said plurality of holes onto said transfer belt.

5. The apparatus of claim 1, wherein said transfer belt is a continuously rotating belt.

6. The apparatus of claim 1, wherein said transfer belt is a Teflon coated, fiberglass belt.

7. The apparatus of claim 1, wherein the thickness of said screen is between 0.008" and 0.012".

8. The apparatus of claim 5, wherein said transfer belt is adapted to contact said garments delivered from said delivery means and transfer said dot pattern to said garments.

9. The apparatus of claim 8, wherein said garments are adapted to remain in contact with said transfer belt for a predetermined period of time.

10. The apparatus of claim 1, wherein said delivery means comprises conveyor means adapted to deliver said garments to said apparatus for application of said dot pattern of said composition and to remove said garments from said apparatus after application of said composition.

11. The apparatus of claim 10, wherein said conveyor means includes three stages.

12. The apparatus of claim 11, wherein said garments are adapted to be placed onto said conveyor means during said first stage, imprinted with said dot pattern during said second stage and removed from said conveyor means during said third stage.

13. The apparatus of claim 11, wherein said conveyor means include a plurality of mandrels over which said garments are placed during said first stage and removed therefrom during said third stage.

14. The apparatus of claim 13, wherein said garments are hosiery products having sole portions, and wherein the dot pattern of said composition is adapted to be imprinted onto said sole portions.

15. The apparatus of claim 14, wherein said hosiery products are adapted to be drawn over said mandrels in said first stage such that said sole portions of said garments are mounted in a face up position.

16. A method for applying dot patterns of a non-slip composition continuously to a plurality of garments, said method comprising the steps of:

delivering said plurality of garments by conveyor means to a transfer apparatus for applying said non-slip composition in said dot patterns;

introducing said composition into a transfer roller provided in said transfer apparatus, said transfer roller including a screen in the form of a cylinder with a plurality of holes provided therein arranged in the dot patterns to be transferred to said garments;

forcing said composition through said holes onto a rotating transfer belt positioned adjacent said transfer roller;

transferring said dot patterns from said transfer belt to said garments;

heating said transfer belt to accelerate drying of the non-slip composition imprinted onto said garments while said garments are in contact with said belt; and removing said garments from said conveyor means.

17. The method of claim 16, wherein said plurality of garments are delivered to said transfer apparatus on mandrels.

18. The method of claim 17, wherein said garments are hosiery products having sole portions and wherein said dot patterns of said composition are imprinted in said sole portions of said hosiery products.

19. The method of claim 18, wherein said dot patterns are continuously transferred from said transfer roller to said transfer belt and thereupon continuously transferred from said transfer belt to said garments.

20. The method of claim 16, wherein said composition is introduced into said transfer roller through a delivery tube from a reservoir.

21. The method of claim 20, wherein said composition is forced through said holes by use of a doctor blade.

* * * * *